United States Patent [19]

Knecht

[11] Patent Number: 4,473,908

[45] Date of Patent: Oct. 2, 1984

[54] GARMENT

[76] Inventor: Gabriele Knecht, 413 Bleecker St., New York, N.Y. 10014

[21] Appl. No.: 386,221

[22] Filed: Jun. 8, 1982

[51] Int. Cl.[3] ..... A41B 1/00

[52] U.S. Cl. ..... 2/115; 2/88; 2/90; 2/114; 2/115; 2/243 B; 2/243 R; 2/DIG. 4

[58] Field of Search ..... 2/88, 90, 105, 114, 2/DIG. 7, 243 R, 243 B, 115, DIG. 4, 125

[56] References Cited

U.S. PATENT DOCUMENTS

| | | | |
|---|---|---|---|
| 294,637 | 3/1884 | Kreisel | 2/90 |
| 2,341,797 | 2/1944 | Lesser . | |
| 2,341,798 | 2/1944 | Lesser . | |
| 2,343,103 | 2/1944 | White . | |
| 2,369,416 | 2/1945 | Solomon . | |
| 2,374,440 | 4/1945 | La France . | |
| 2,386,768 | 10/1945 | Ayoub . | |
| 2,387,405 | 10/1945 | Neilson . | |
| 2,568,805 | 12/1949 | Hare | 2/243 R |
| 2,650,364 | 9/1953 | Clyne . | |
| 2,742,647 | 4/1956 | Khalil . | |
| 2,798,225 | 7/1957 | Jacobson . | |
| 2,846,687 | 8/1958 | Lippman . | |
| 2,848,719 | 11/1958 | Clyne | 2/125 |
| 2,941,210 | 6/1960 | Bren . | |
| 2,986,740 | 6/1961 | Schudson . | |
| 3,013,276 | 12/1961 | Maxwell . | |
| 3,078,699 | 2/1963 | Huntley . | |
| 3,255,459 | 6/1966 | Way | 2/243 R |
| 3,369,300 | 11/1966 | Green | 2/125 |
| 3,614,789 | 10/1971 | Menut . | |
| 3,654,632 | 4/1972 | Lacroix . | |
| 3,813,697 | 6/1974 | Belpaume . | |
| 4,004,297 | 2/1977 | Polack . | |
| 4,068,321 | 1/1978 | Chayer . | |
| 4,069,513 | 2/1978 | Shiller . | |
| 4,097,933 | 7/1978 | de Polo . | |
| 4,215,685 | 8/1980 | Ibel . | |
| 4,240,158 | 12/1980 | de Polo . | |
| 4,249,268 | 2/1981 | Berler . | |
| 4,261,060 | 4/1981 | Zawacki . | |
| 4,304,007 | 12/1981 | Ito | 2/90 |

FOREIGN PATENT DOCUMENTS

| | | | |
|---|---|---|---|
| 394321 | 6/1933 | United Kingdom | 2/DIG. 4 |
| 2027330 | 2/1980 | United Kingdom . | |

OTHER PUBLICATIONS

Mallan, *Suiting Up for Space,* p. 29, ©1971, John Day Company.

*Primary Examiner*—Werner H. Schroeder
*Assistant Examiner*—Mary A. Ellis
*Attorney, Agent, or Firm*—Curtis, Morris & Safford

[57] ABSTRACT

Garments covering the arms and upper torso made of a one-piece or multi-piece pattern in which the central axis of the sleeves are naturally positioned forward of the lateral plane of the body (rather than with the conventional fitted position placement in the lateral plane). The low point of the armhole is advantageously at the side front in the center of the armpit when the arm is raised. The garment is fitted to accommodate arms positioned at an angle substantially forward of the lateral plane of the body, preferably ranging between about 18° and about 45°. Contrary to conventional wisdom, the garments fit a body position which is in the center area of the natural arm movement range relative to the torso and which is naturally unsymmetric between front and back.

8 Claims, 53 Drawing Figures

FIG. 4A
PRIOR ART
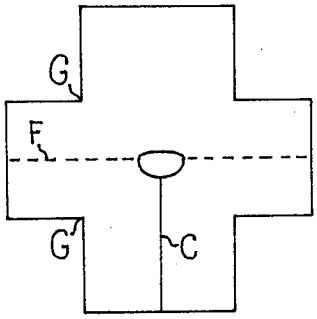
FIG. 4B
PRIOR ART
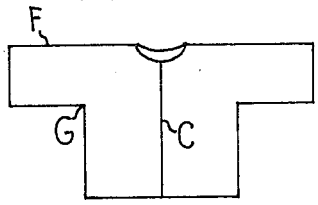
FIG. 4C
PRIOR ART
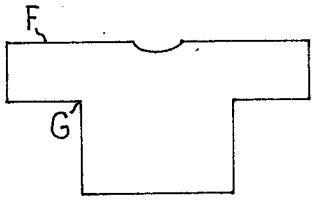
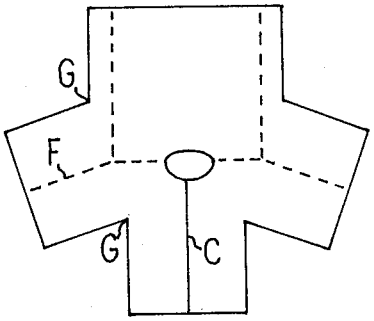
FIG. 5A
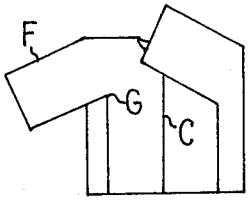
FIG. 5B
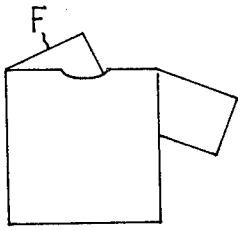
FIG. 5C
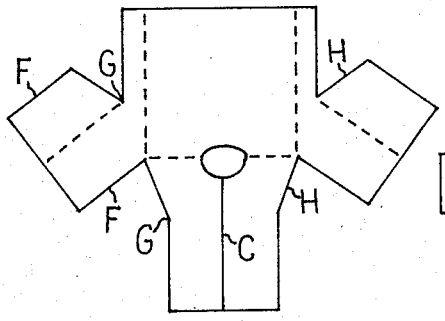
FIG. 6A
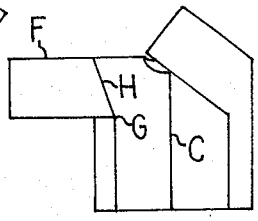
FIG. 6B
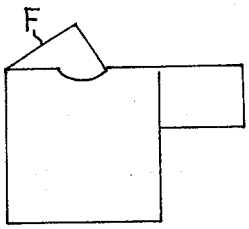
FIG. 6C
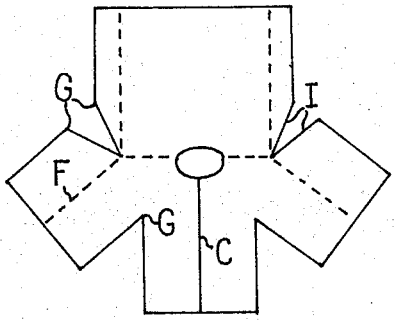
FIG. 7A
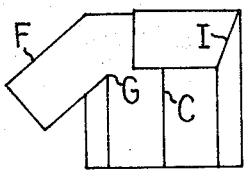
FIG. 7B
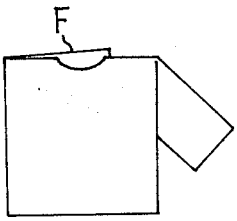
FIG. 7C

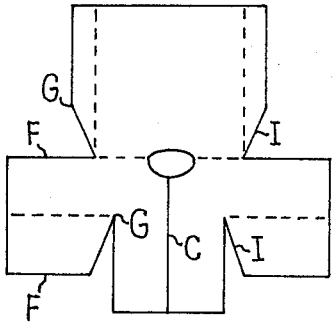
FIG. 6AA
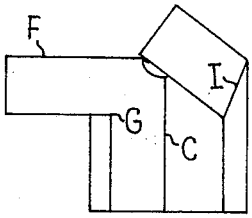
FIG. 6BB
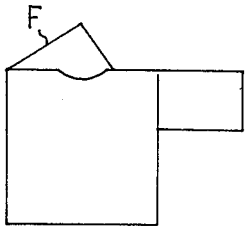
FIG. 6CC
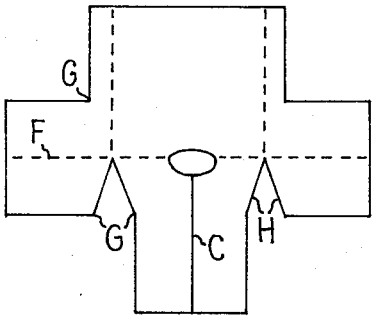
FIG. 7AA
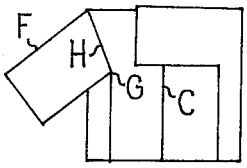
FIG. 7BB
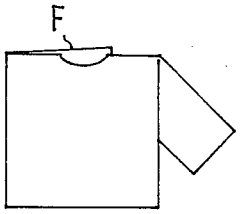
FIG. 7CC
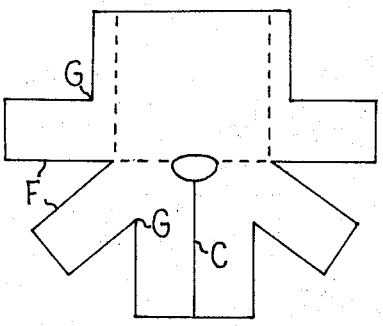
FIG. 7AAA
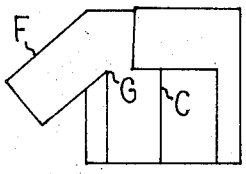
FIG. 7BBB
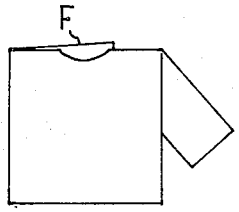
FIG. 7CCC

GARMENT

FIELD OF THE INVENTION

This invention relates to the construction of sleeved-type garments. More particularly, the term "sleeved-type garment" is used broadly to include shirts, blouses, sweaters, dresses, jackets, suits, coats, jumpsuits, underclothing, and similar garments which have a body portion covering at least the upper portion of the torso and sleeve portions individually covering at least an upper portion of the arms of the wearer. This invention is applicable to garments for men, women, children and infants.

In addition to every-day clothing, this invention is particularly applicable to garments for active physical use such as sportswear, uniforms and occupational clothing, and to garments for the handicapped and injured. These can include clothing for camping, mountain climbing, skiing, skating, ice hockey, tennis, gymnastics, basketball, football, baseball; astronauts, musicians, dancers, armed services, police, fireman, etc.

BACKGROUND OF THE INVENTION

Conventional shirt-type garments have their sleeves positioned so as to extend outwardly in opposite directions from the trunk portion at 180° from each other. In other words, the central axis of the sleeves in conventional shirt-type garments can be thought of as lying in a single lateral plane through the body (i.e. the plane through the trunk which separates the anterior and posterior portions thereof). Thus, if the median plane of the body divides the body into left and right halves, then the lateral plane is perpendicular thereto. A one-piece pattern which illustrates this construction is the so-called kimono sleeve (as shown in FIG. 4A). The sleeves are in the lateral plane of the body and extend out horizontally at shoulder level. The kimono sleeve pattern is the basis from which conventional shirt-type garments comprised of multi-piece patterns are made. Two such variations are the so-called set-in sleeve and the so-called raglan sleeve. In each of these variations the central axis of the sleeves is angled below the horizontal of the shoulders, but they are still in the lateral plane of the body.

This setting of the sleeve direction within the lateral plane in the design of conventional sleeved-type garments implicitly assumes that the arms move equally in all directions around the body. If the natural arm movement range were equal in all directions then, indeed, the most logical placement of the sleeves in relation to the body would be in the lateral plane making the center of the movement range symmetric between front and back.

In conventional garments while the armholes may be cut out more from the front than from the back, the sleeves are conventionally set in to fit arms positioned at the sides, rather than to fit arms positioned in a substantially forward position.

In early pressurized space suits made of fabric which is inflexible when inflated, the sleeves appear to have been necessarily set at a relatively fixed forward position (in order to be at all functional). Applicant, long after making her invention, came across a recent reference to a discussion of the first functional Wiley Post 1939 pressurized suit on page 29 of the book "Suiting Up for Space" by Lloyd Mallan (New York: The John Day Co., 1971). The description in this book of the construction of this suit is very vague. In any event, in subsequent decades, no one has ever thought that such relatively rigid positioning could be adapted to be useful for more conventional garments made from flexible materials. Such early space suits were apparently not concerned with accomodating the range of natural motions, but rather with a set functional position under essentially inflexible restrictions.

The sleeved-type garments which are the subject of this invention are open to the ambient atmosphere, unlike the aforementioned completely functionally rigid and sealed pressurized space suits. A gas and/or water impermeable wet suit, even with relatively tight cuffs, could still be encompassed within the "atmospherically open" sleeved-type garments of the present invention, because the cuffs and neck openings are not significantly sealed from the outside atmospheric pressure.

SUMMARY OF THE INVENTION

Applicant, apparently for the first time in this ancient clothing art, has focused on the fact that while one's arms have a large range of movement around the body, this freedom of movement is not equal in all directions. One can easily hug oneself in front across the chest, but cannot normally hug oneself in back. Arms have a greater comfortable movement range toward the front of the body than toward the back, making the center of natural movement range asymmetric between front and back (see FIG. 1).

In the present invention, the sleeves are fitted to accomodate arms positioned substantially forward of the lateral plane through the body in a position which preferably corresponds to the approximate center of the range of arm movements. A garment made according to this invention is fitted to arm positions preferably ranging between about 18 degrees and about 45 degrees forward of the lateral plane for a garment intended for normal everyday use. This design reduces bunching up in one direction and pulling of fabric in the other, and is the basis for applicant's forward directed sleeve sleeved-type garment. One of the preferred ways of accomplishing the forward direction in the sleeve is by moving the low point of the armhole forward, while leaving the high point in the lateral plane of the body. Examples of this are illustrated and discussed below. Although not preferred, it is possible to practice this invention in its broader aspects by using armholes cut symmetrically at the sides but with sleeves that are asymetrically shaped so as to give the desired forward angle.

From the simple one-piece pattern embodying this invention, multi-piece pattern variations can be made which place the seams in similar ways as in the set-in sleeve and the raglan sleeve of conventional garments, or in a great variety of designer styled or occupationally dictated additional new ways, all having a forward positioned sleeve.

BRIEF DESCRIPTION OF THE DRAWINGS

In this specification and in the accompanying drawings, I have shown and described preferred embodiments of my invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

For purposes of simplicity and clarity, FIGS. 4A to 7CCC show simplistic "basic block" patterns in flat configurations (without any shape or drape). Such patterns may be used as a template or tool from which other patterns may be developed.

FIG. 4A shows a one-piece pattern of conventional sleeved-type garments with the center line F of the sleeves following the lateral plane through the body.

FIG. 4B shows the front view and

FIG. 4C shows the back view of the assembled garment made from the pattern shown in FIG. 4A. Except for the lower front neckline, the front and back of the body and sleeves are interchangeable. The low point G of the armhole is at the side at an equal distance between center front C and center back.

FIG. 5A shows a one-piece pattern for making a sleeved-type garment in accordance with the present invention wherein the center line F of the sleeves is forward of the lateral plane through the body.

FIG. 5B shows the front view and

FIG. 5C shows the back view of the assembled garment made from the pattern shown in FIG. 5A. The front and back of the body and sleeves are not interchangeable. The low point G of the armhole is at the side front closer to center front C than to center back.

FIGS. 6A and 7A show two different alternative one-piece patterns for making sleeved-type garments in accordance with the present invention.

FIGS. 6B and 6C show the front and back views of the assembled garment made from the pattern shown in FIG. 6A.

FIGS. 7B and 7C show the front and back views of the assembled garment made from the pattern shown in FIG. 7A.

FIG. 6AA shows one variation of sleeve construction from that of the one-piece pattern shown in FIG. 6A.

FIGS. 6BB and 6CC show a front and back view respectively of an assembled garment made from the pattern of FIG. 6AA.

FIGS. 7AA and 7AAA show two variations of sleeve construction from that of the one-piece pattern shown in FIG. 7A.

FIGS. 7BB & 7CC and 7BBB & 7CCC show assembled garments made respectively from the pattern in FIGS. 7AA and 7AAA.

In the foregoing figures, the dotted lines represent fold lines. No such fold lines appear in the following figures (do not confuse the dotted lines shown in these latter figures, in which the dotted lines depict stitching).

Figure 8:
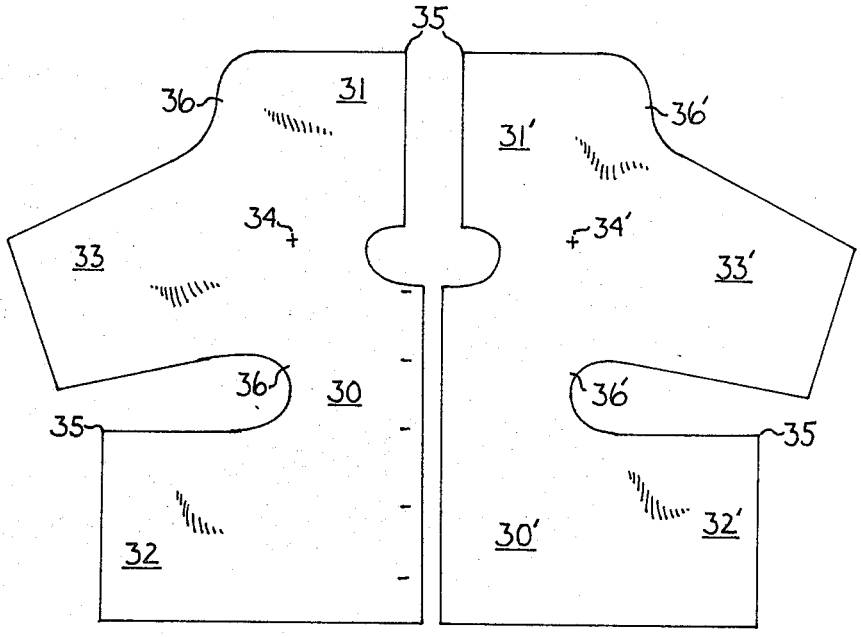
Figure 11A:
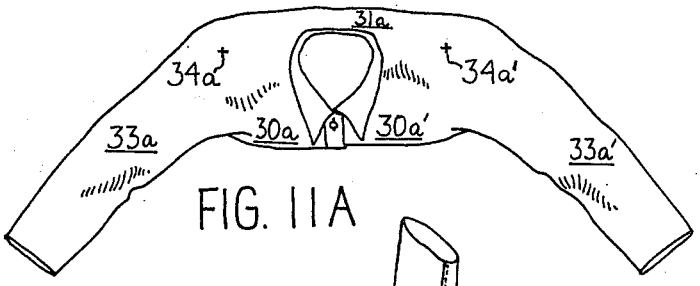
Figure 9A:
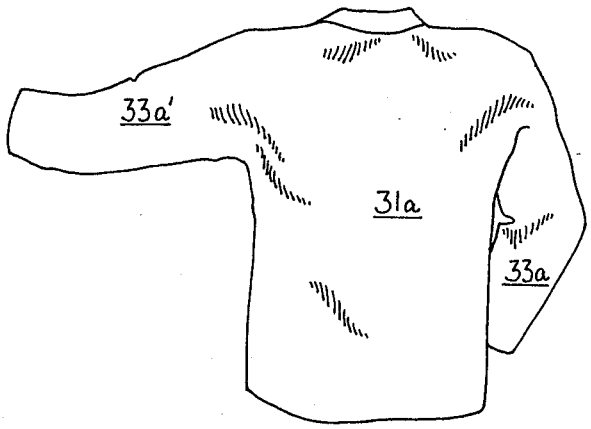

The remaining figures show examples of three-dimensional practical adaptations of the previously illustrated "basic block" patterns:

FIG. 8 shows a two-piece pattern variation based on the one-piece pattern shown in FIG. 5A for making a sleeved-type garment in accordance with the present invention.

Figure 8A:
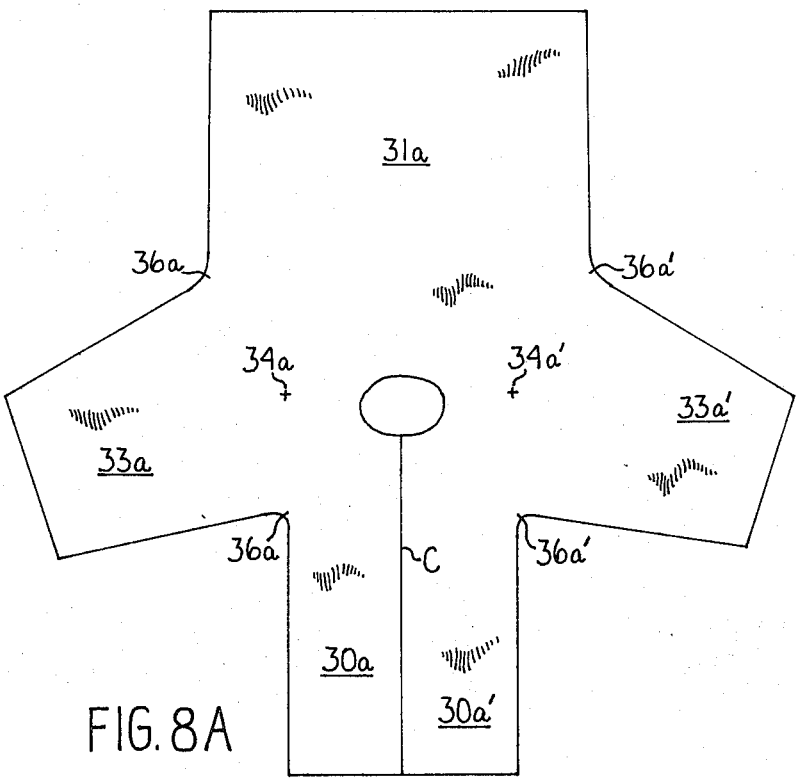
Figure 11B:
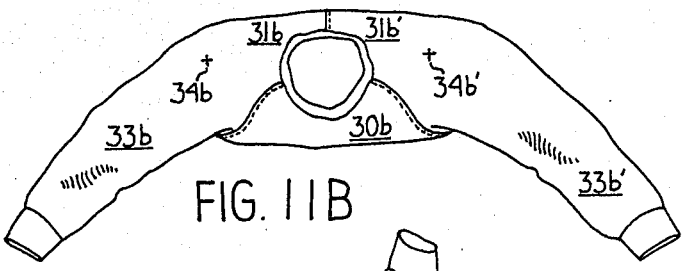
Figure 9B:
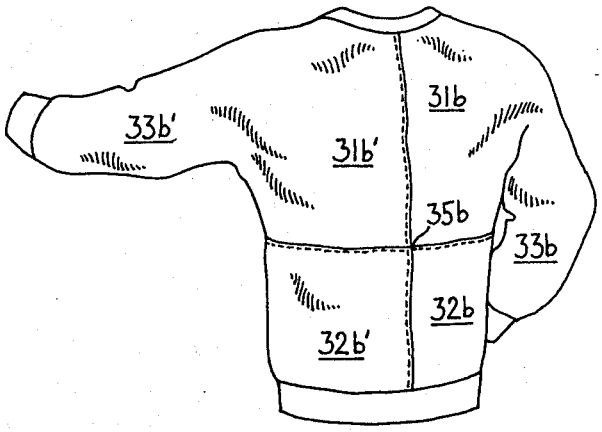
Figure 8B:
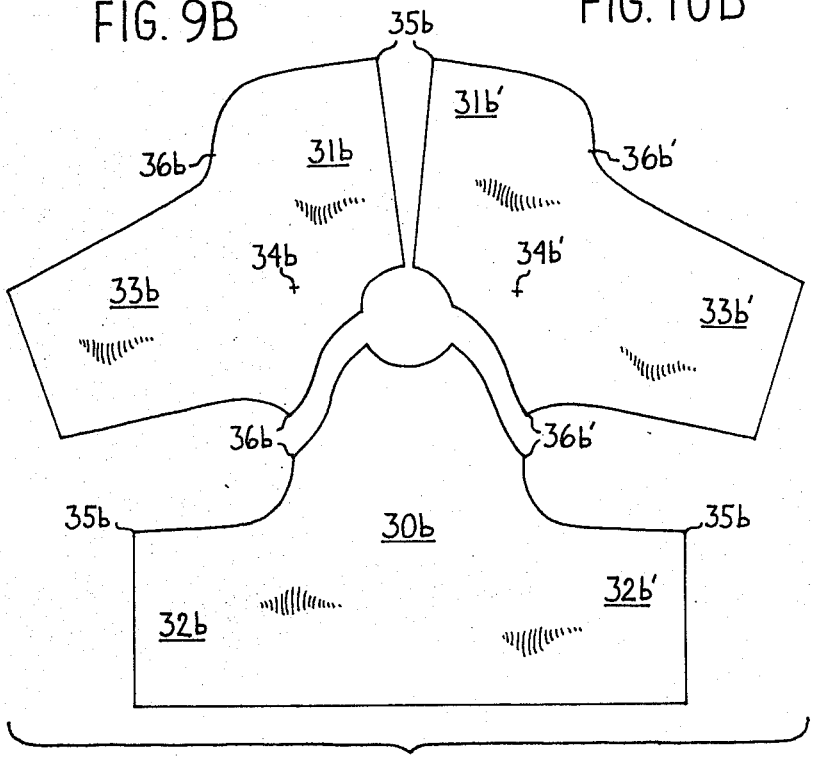
Figure 9C:
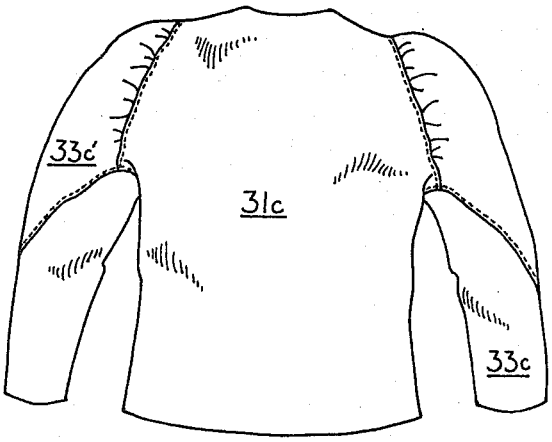
Figure 10C:
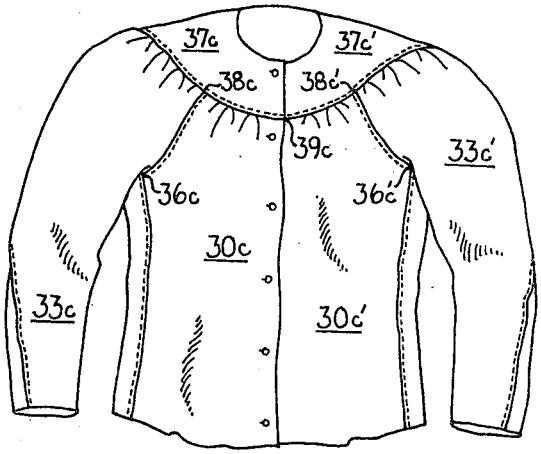
Figure 8C:
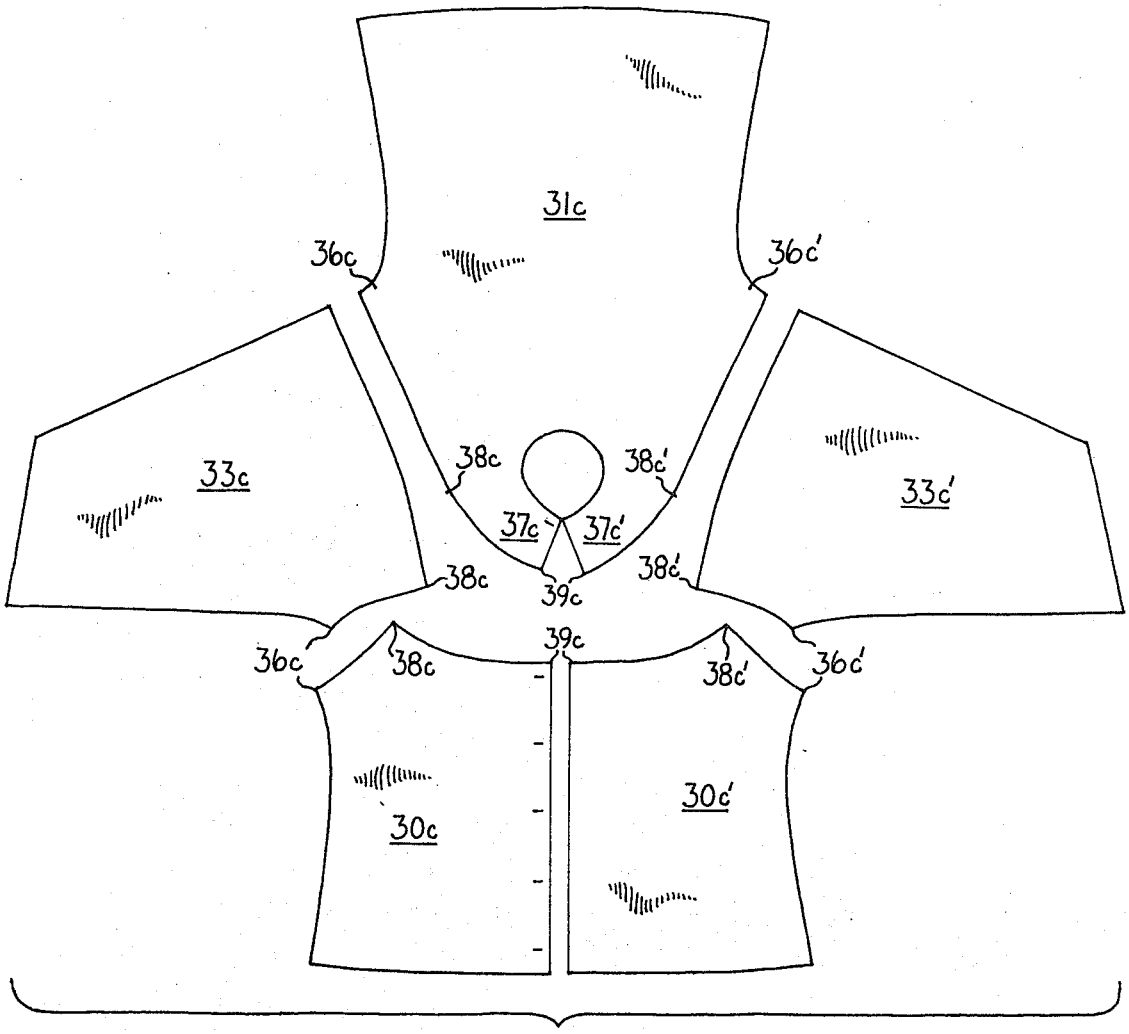

FIGS. 8A, 8B and 8C respectively, show a one-piece pattern, a three-piece pattern and a five-piece pattern, which illustrate a few of the design variations which are possible.

Figure 11:
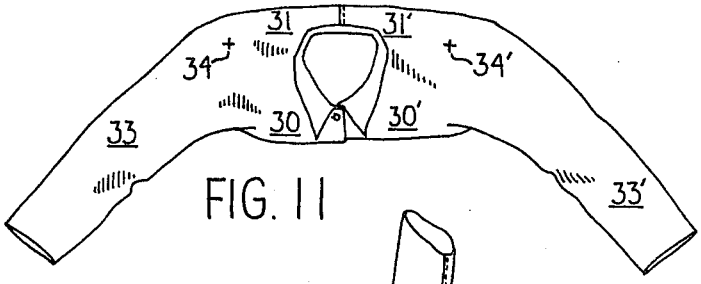
Figure 9:
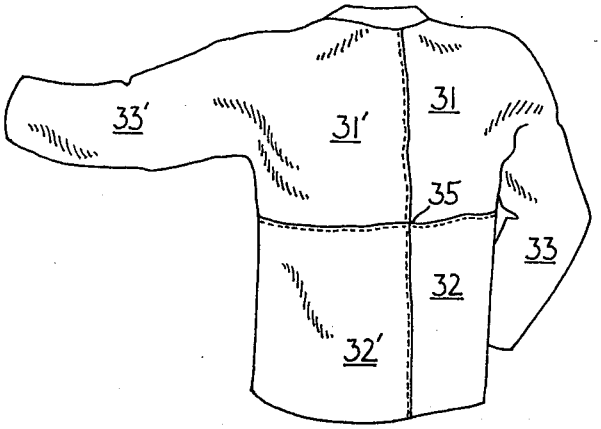
Figure 10:
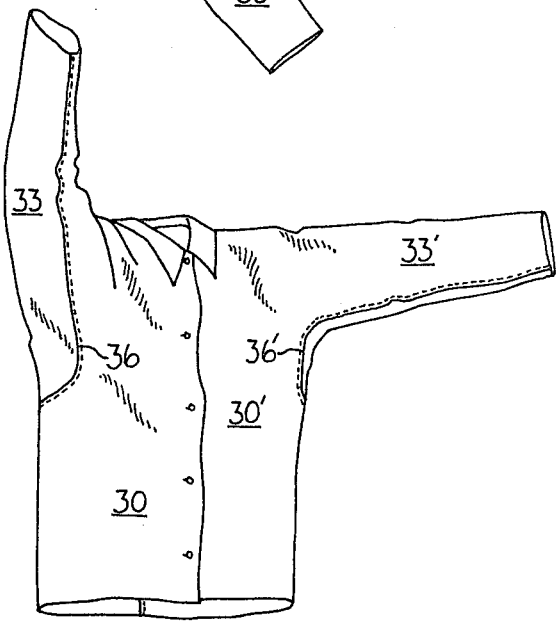

FIGS. 9 to 11 show a back, front and plan view of the assembled garment made from the pattern of FIG. 8.

FIGS. 9A to 11A, 9B to 11B and 9C to 10C are similar to FIGS. 9 to 11, but based respectively on the patterns of FIGS. 8A, 8B, and 8C.

Figure 12:
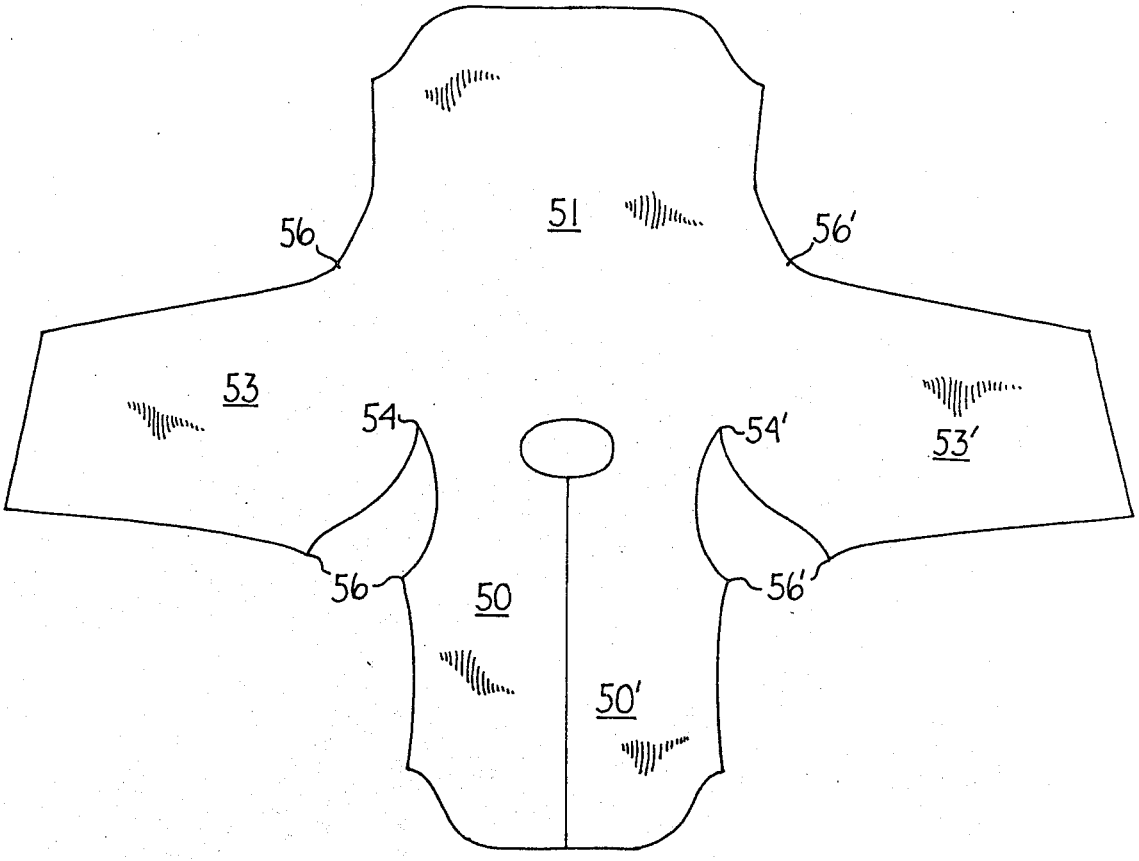

FIG. 12 shows a one-piece pattern variation based on the pattern shown in FIG. 7AA for making a sleeved-type garment in accordance with the present invention.

Figure 13:
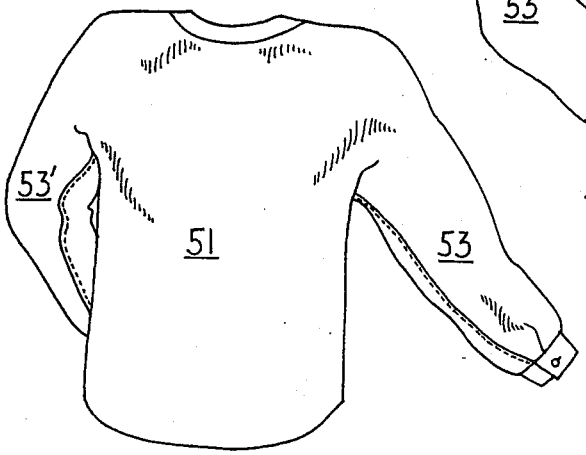
Figure 14:
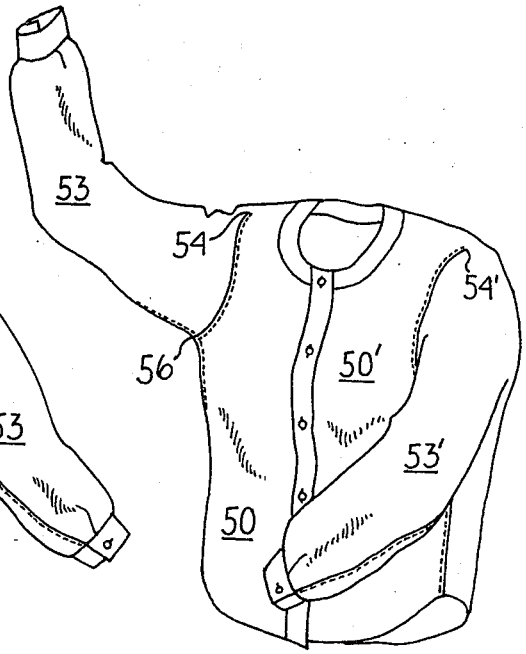
Figure 15B:
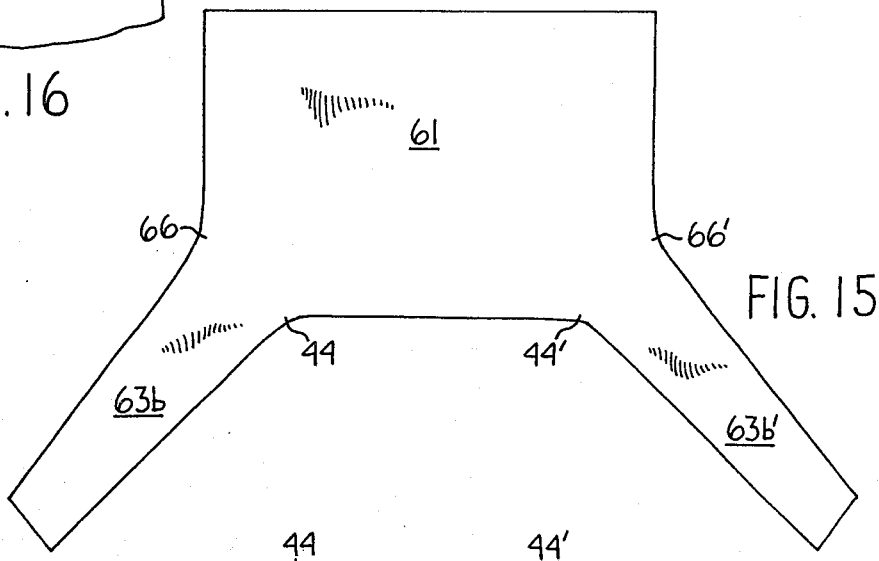
Figure 15A:
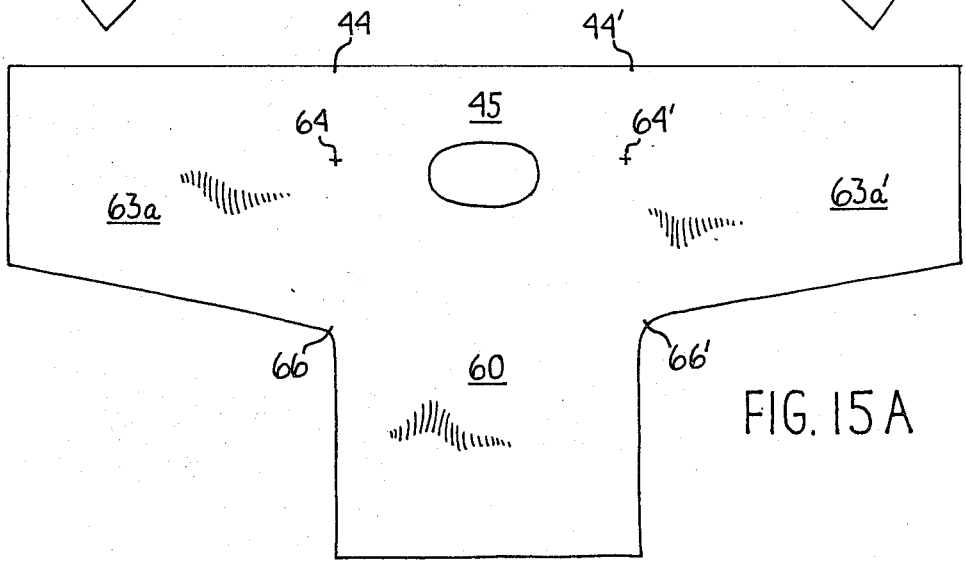

FIGS. 13 and 14 show the back and front view of the garment made from the pattern shown in FIG. 12;

FIGS. 15A and 15B show a two-piece pattern variation based on the one-piece pattern shown in FIGS. 6A or 6AA for making a sleeved-type garment in accordance with the present invention.

Figure 16:
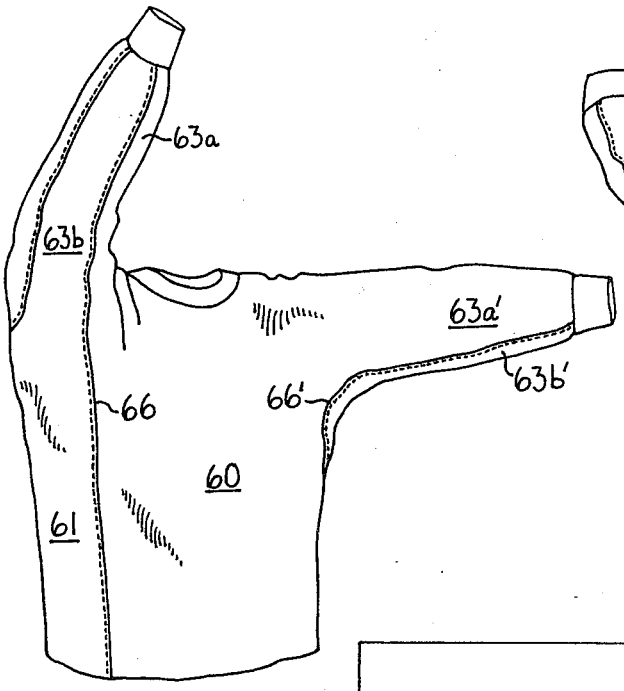
Figure 17:
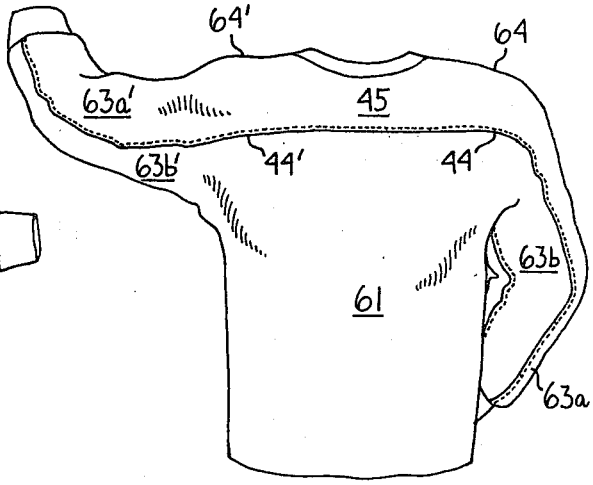

FIGS. 16 an 17 show the front and back view of the garment made from the pattern in FIGS. 15A and 15B.

Figure 18B:
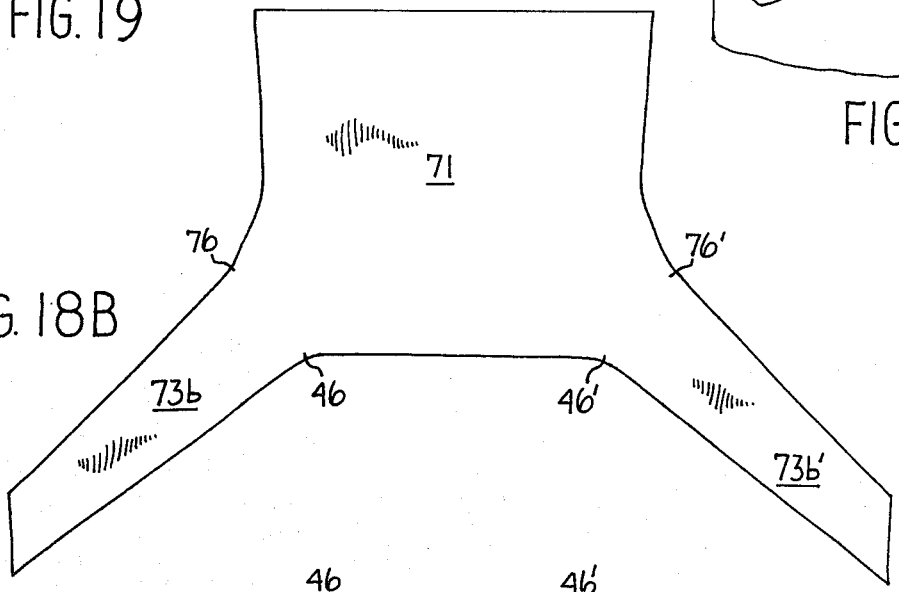
Figure 18A:
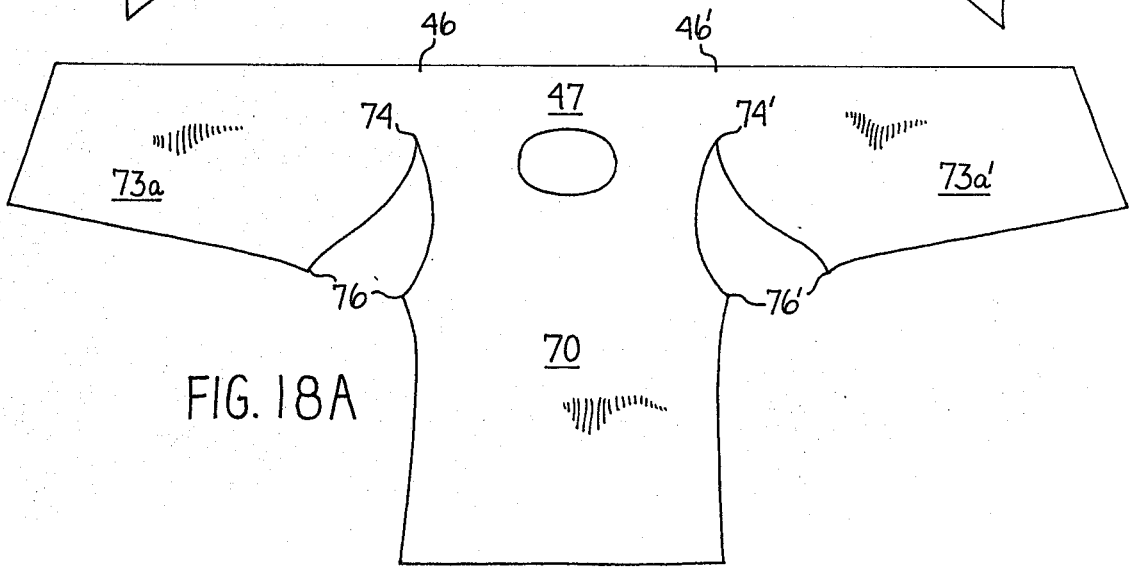

FIGS. 18A and 18B show a two-piece pattern variation similar to the patterns shown in FIGS. 15A and 15B having an extra seam for a closer fit at the armhole.

Figure 19:
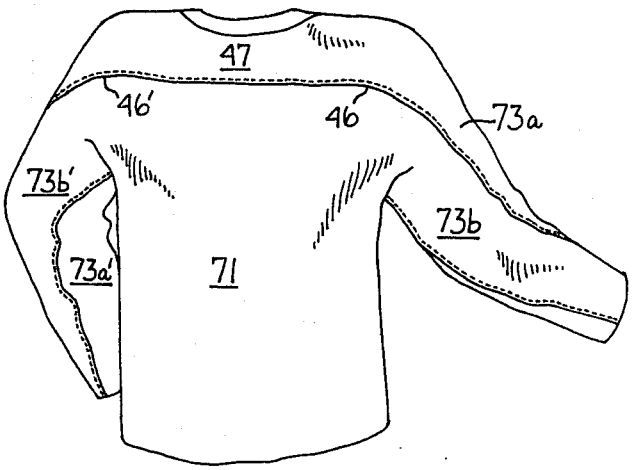
Figure 20:
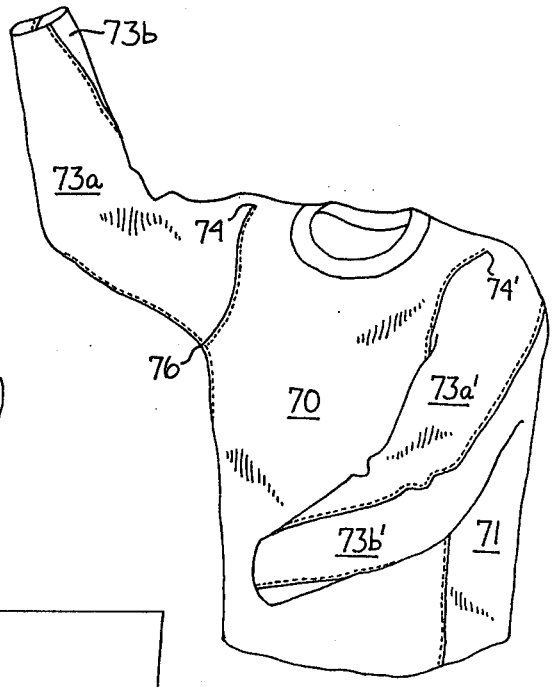

FIGS. 19 and 20 show the back and front view of the garment made from the pattern shown in FIGS. 18A and 18B.

Figure 21:
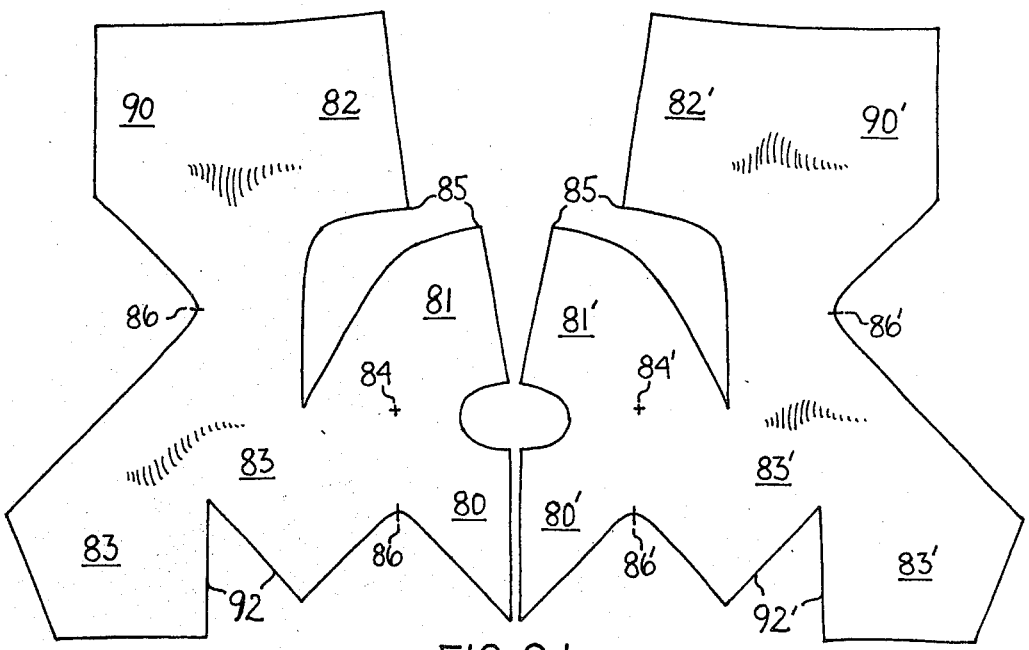

FIG. 21 shows a two-piece pattern variation based on the one-piece pattern shown in FIG. 5A but with a more pronounced (45°) forward sleeve angle and with a partial elbow seam in the sleeve sections which gives the lower part of the sleeve a further (22½°) forward angle.

Figure 22:
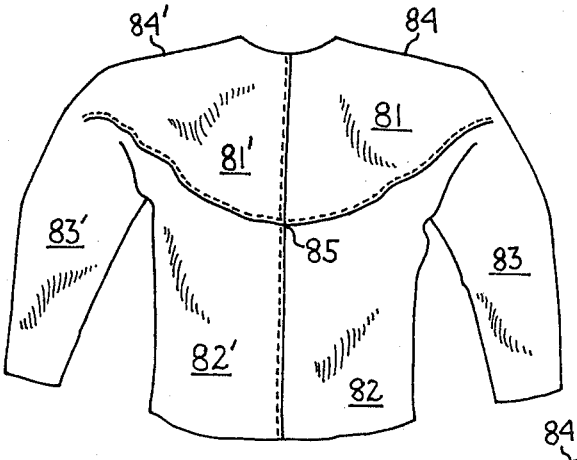
Figure 23:
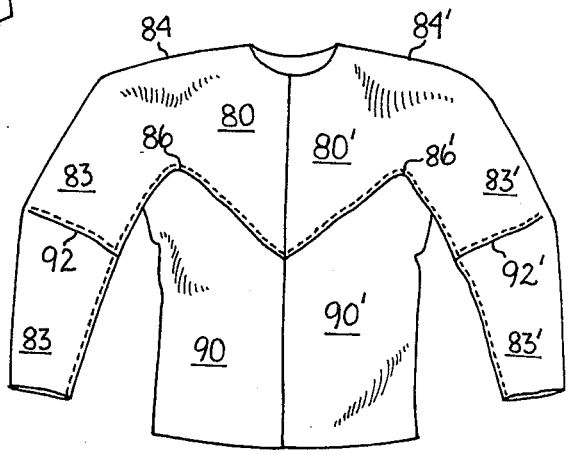

FIGS. 22 and 23 show the back and front view of the garment made from the pattern shown in FIG. 21.

DETAILED DESCRIPTION

A simple one-piece pattern embodying a basic construction of the present invention is shown in FIG. 5A.

Two additional one-piece pattern variations of a forward positioned sleeve according to applicant's invention are shown in FIGS. 6A and 7A. In the variations shown in FIGS. 6AA, 7AA, and to a lesser degree 7AAA, the center line of the sleeves appears to be in or parallel to the lateral plane. However, when the garment is sewn together the sleeve has an orientation forward of the lateral body plane. Thus, except for seam placement, the finished garments in FIGS. 6B and 6BB are the same in shape. This is also true for FIGS. 7B and 7BB.

The central axis of the sleeve (or at least the upper portion thereof, if the sleeve has a set bend as in FIG. 23) is perhaps a better indicator of the forward direction of a given sleeve than is the center line F. The central axis is the line of symmetry that a sleeve has when worn (as opposed to being merely folded flat). The forward orientation of the garment is then the angle in the horizontal plane that the central axis of the sleeve makes with the lateral plane of the garment's body portion when the sleeve is in its fitted position (i.e., the position of minimum stress or "pull" on the fabric). If the garments were capable of being inflated, the sleeves would assume the aforementioned "fitted position".

FIGS. 5B, 6B and 7B all show garments with forward angled sleeves; the difference among these being in the degree of vertical freedom. The garments of FIGS. 5A and 6A have more upward freedom, while that of FIG. 7A has a more natural downward freedom of movement. Another difference is that the garment in FIG. 6B shows a partial armhole seam H on the side of the sleeve closest to center front C, while the garment in FIG. 7B shows a partial armhole seam I on the side of the sleeve closest to center back. A further difference is that FIG. 6A shows the center line F following the seam edges of the sleeve section. FIGS. 5A, 5B, 6A, 6B, 7A and 7B all show the low point G of the armhole in exactly the same place.

Figure 10A:
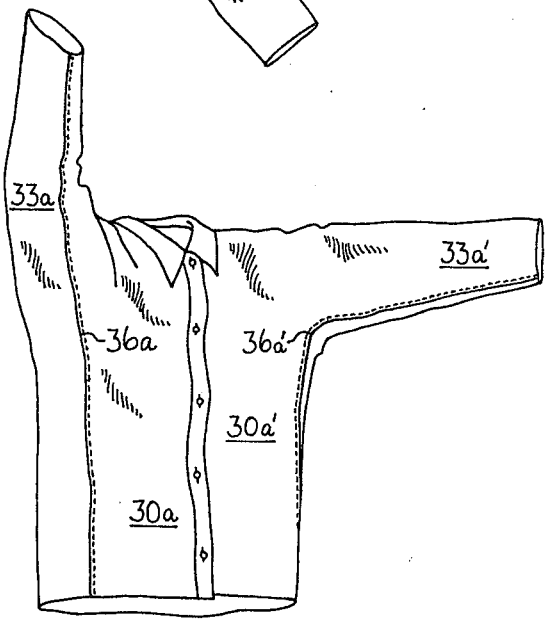
Figure 10B:
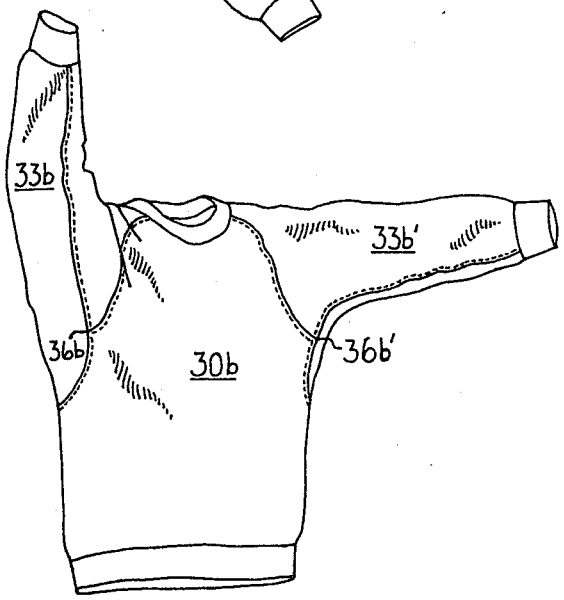

This serves to illustrate that even with the same forward slanted armhole, there can be variations in the vertical component of the forward sleeve angle. Note also that by shifting the low point G further around, the horizontal forward sleeve angle can be significantly increased (as illustrated in FIG. 21). It will be understood that point G in FIG. 5A is equivalent to point 36 in FIGS. 8 to 11 and to point 86 in FIGS. 21 to 23. However, as the seam line is shifted, the position of the "low point" becomes blurred, and the point in question may better be called the underarm point (i.e., the underarm point on a seam line where transition from the sleeve to the body of the garment occurs). See for example, points **36*b* and 66 in FIGS. 10B, 15B, and 16**.

In FIGS. 8 through 23, actual garments are shown in juxtaposition to the patterns from which they are made. To aid in the better understanding of the construction of each garment, the various portions of the garment are indicated by appropriate reference numerals; such as 30, 50, 60, 70, and 80 for the front panel; 31, 51, 61, 71, and 81 for the back panel; 32 and 82 for the lower back panel (if separate); 33, 53, 63, 73, and 83 for the sleeve; 34, 54, 64, 74, and 84 for the shoulder point; 35 and 85 for the back seam intersection; 36, 56, 66, 76 and 86 for the underarm point, **37*c* for the yoke (see FIG. 8C), 38*c* for the point of joinder of the yoke seam with the armhole seam, and 39*c* for the point of intersection of the yoke seam and the front opening. See also curvature points 44 and 46 in FIGS. 15A to 17 and 18A to 20, respectively (which help to show how the pattern is assembled into the finished garment). Points 45 and 47** show the back yoke position in the same respective drawings.

In FIGS. 21 to 23, 80 is just the upper panel, 90 is the lower front panel, and 92 is the partial elbow seam.

As best seen in FIG. 23, the sleeve 83 has a dart in it, resulting in an elbow seam 92. This gives a fit to the sleeve where the forearm is at a relaxed angle to the upper arm (here illustrated as at 22½° from the straight arm position). For working at a desk or the like, this can be a more common orientation of the arms and is therefore preferred in such circumstances.

A prime (') is used to indicate portions on the left side and to differentiate from corresponding portions on the right side of the garment. These are used in FIGS. 8 to 23 in particular. In FIGS. 8A, 8B and 8C where similar portions have the same reference numerals, the letters a, b and c have been added, respectively, to differentiate among the corresponding figures.

Figure 1:
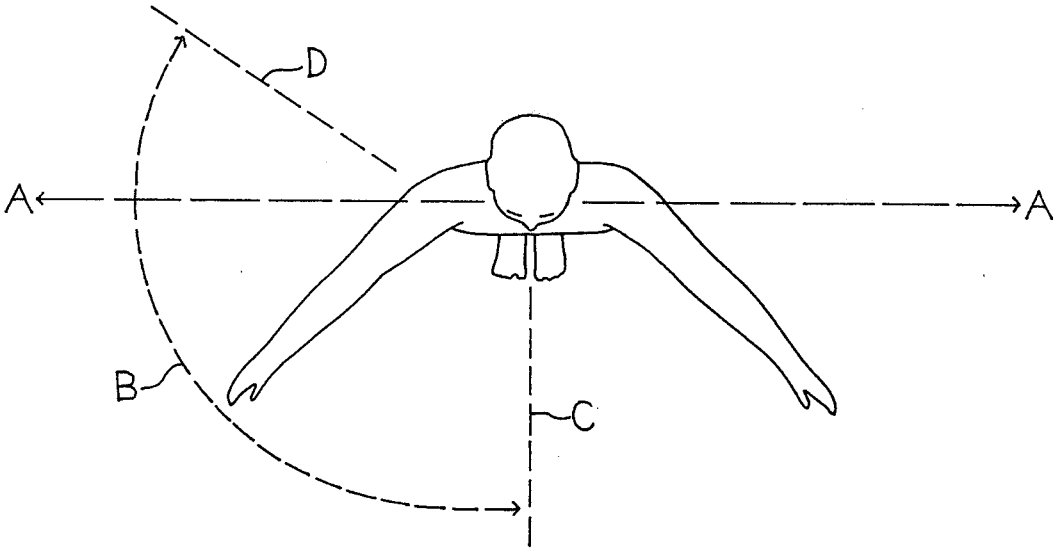
FIG. 1 shows a plan view of the human body with the position of the arms in the center of the natural range of arm movement, and showing on line A—A the lateral plane through the body, and as line B the range of natural arm movement (with line C as the center in front and line D as the back limit of comfortable arm extension)
Figure 2:
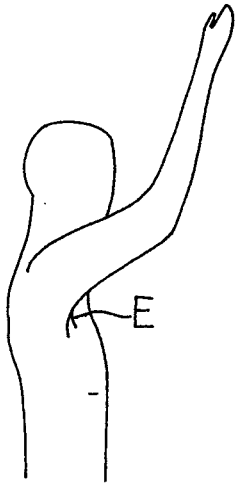
FIG. 2 is a side view.
Figure 3:
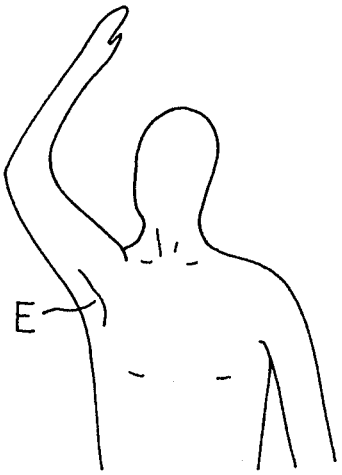
FIG. 3 is a front view of the human body showing how the center of the armpit shifts towards the front as the arm is raised above the head.

The armpit is at the side of the body when the arm is hanging at the side, but when the arm is raised straight above the head or is moved forward, the articulation of the arm and the stretching of the back muscles causes the armpit to shift to the front so that it cannot be seen from the back (FIGS. 2 and 3). This shift results in the need for additional fabric at the back sleeve and upper rear body area. A similar, less pronounced, shift also occurs at the shoulder level.

Conventional sleeved-type garments place the low point of the armhole at the side at equal distance from center front and center back. When the arms move forward, this underarm point of the conventional garment remains fixed at the side and causes substantial pulling across the back of the garment. This has been compensated for by the use of placques, shirring, elastic inserts, "formless" fullness, and the like; but none appear to have ever anticipated applicant's design.

In a preferred embodiment of this invention, the low point of the armhole is placed at the side front, in the center of the armpit when the arm is raised. Shifting the low point of the armhole forward, while leaving the high point at the side, results in a better fitting, more comfortable garment with reduced stress placed on the underarm point. Also, by bringing the side body seam and the underarm sleeve seam through the center of the armpit it is possible to provide the necessary shaping for up and down expansion in the armpit. This can avoid pulling out ones shirt tails (see for example FIG. 10A).

The genius of applicant's unique design is in basing the fit of the garments on the averaged dynamic body position and changing muscle shape as well as on mere static body dimensions.

The human body comes in a variety of shapes and sizes but has one universal way of moving. Garments which fit the natural way of moving, as well as the size and shape of the wearer, provide a new dimension for a better fitting, more comfortable garment with advantageously less pull and less bunching of the fabric.

Conventional sleeved-type garments fit a body at rest with the arms at the sides, concentrating on body size and leaving enough room for required movement. The fit is based on the exterior dimension of the body and on shaping of the seams. Thus, the conventional garment is cut to fit a relatively extreme position in the range of natural arm movements. In contrast, applicant's garments are cut with the sleeve naturally positioned forward of the lateral plane at an angle which is more in the center of natural movement, with a shorter angular distance needed to move to any of the natural extreme arm positions (such as raised arms, hanging arms, and hugging arms). With less angular movement needed there will be less bunching and less pull.

Thus, an added benefit is that a garment made according to applicant's invention need not depend for flexibility mainly on the type of fabric from which it is made, because applicant's also has greater moveability inherent in the fit than does a conventional garment.

It will be appreciated that the design of garments according to this invention are based on an asymmetric structure.

Conventional sleeved-type garments have always been based on a pattern having a symmetry in the lateral plane. Before there were designers, regional costumes were based on a structure where the front and back of a sleeved-type garment were interchangeable, and the garment could be worn with either side toward the front. Designers continue to use this basic structure, varying the shape and fit, but keeping an essentially symmetric approach.

Applicant's invention provides the basis for new designs by allowing room for arms to move forward, making an asymmetric structure with front and back not interchangeable. This allows new shapes for sleeved-type garments which have a definite difference between front and back. Seams can be placed in new ways and fabric can be cut from new angles, providing a great variety of new designs. Thus, though the invention is a technical innovation, it lends itself to unique fashion improvements.

The amount of fabric required to make a conventional sleeved-type garment and a garment from the present invention is essentially the same. The difference is that a garment made from this invention utilizes this amount of fabric in a more economical way be placing the fabric where it is needed the most for body movement. In some cases this also results in using less fabric than would be required for making a conventional shirt (for example by requiring less overall fullness and better form fitting).

Because the forward sleeve fits the range of natural arm movements, stresses at the armhole are less than for the conventional design. Stresses are conventionally taken up by adding additional material and shaping at the armhole. This latter procedure requires that seams be in their conventional positions, such as in the set-in sleeve and the raglan sleeve, each of which use a minimum of four pattern pieces. Since the forward sleeve has lower stresses and typically will not need additional material and shaping at the armhole, this invention lends itself to one-piece patternmaking (also to two-piece patterns where the body and sleeve are in one piece).

One-piece patterns have fewer seams than multi-piece patterns and take less sewing time thereby reducing the cost of manufacturing a garment.

One-piece patterns give an overview of the total garment area thereby opening up new possibilities of design and manufacturing in terms of seam placement. Seams can be placed to allow fabric patterns to join in a decorative way or as decorative elements themselves, or be positioned to best absorb stresses, or minimize fabric wastage.

Other advantageous uses include use in insulating garments. Insulation in garments depends on a continuously maintained thickness of trapped air surrounding the torso and limbs. As the arms move toward the front in conventional sleeved-type garments, there is typically substantial pulling across the back causing the air to be pressed out (and also pulling at the armhole cutting off an exchange of trapped air between the sleeves and the body section). This invention is thus particularly suitable for garments worn in the cold and designed for vigorous physical activity, such as in skiing and mountain climbing.

I claim:

1. In an atmospherically open sleeved-type garment having a body portion with a defined lateral plane and a sleeve for each arm with a defined central axis, the improvement comprising each sleeve of said garment being made from functionally relatively flexible fabric and being oriented relative to the body portion of the garment in a fitted position with the central axis of at least the upper part of said sleeve at an angle substantially forward of said lateral plane of said garment's body portion.

2. The garment according to claim 1, wherein said angle is between about 18 and about 45 degrees.

3. The garment according to claim 1, wherein the low point of the armhole of each respective sleeve is forward of the shoulder high point of said arm hole.

4. The garment according to claim 2, wherein the low point of the armhole of each respective sleeve is forward of the shoulder high point of said arm hole.

5. The garment according to claim 3, wherein said high point of each armhole of each respective sleeve is approximately in said lateral plane.

6. The garment according to claim 1, wherein each sleeve is fitted with a substantial angle at the elbow in the direction of articulation of such respective elbow.

7. The garment according to any of claims 1 to 5, wherein at least one entire sleeve and part of the adjacent body part of said garment, said portion constituting at least about 25% of said body portion, are made from a single piece of fabric.

8. The garment according to claim 7, wherein the entire garment is made from a single piece of fabric.

* * * * *

UNITED STATES PATENT AND TRADEMARK OFFICE

CERTIFICATE OF CORRECTION

PATENT NO. : 4,473,908

DATED : October 2, 1984

INVENTOR(S) : Gabriele Knecht

It is certified that error appears in the above-identified patent and that said Letters Patent is hereby corrected as shown below:

Column 1, lines 25, 29, and 39, delete "shirt-type" and insert --sleeved-type--.

Column 8, line 37 (claim 7, line 3) delete "part" and insert --portion--; delete "portion" and insert --part--.

Signed and Sealed this

*Second* Day of *July 1985*

[SEAL]

*Attest:*

DONALD J. QUIGG

*Attesting Officer*

*Acting Commissioner of Patents and Trademarks*